US012195238B2

(12) United States Patent
Song

(10) Patent No.: US 12,195,238 B2
(45) Date of Patent: Jan. 14, 2025

(54) DISPOSABLE FOLDING PAPER CUP THAT FOLDS FLAT AND, WHEN UNFOLDED BY PRESSING OF FOLDED PORTION, HAS CYLINDRICAL UPPER END

(71) Applicant: Sang Geun Song, Goyang-si (KR)

(72) Inventor: Sang Geun Song, Goyang-si (KR)

( * ) Notice: Subject to any disclaimer, the term of this patent is extended or adjusted under 35 U.S.C. 154(b) by 165 days.

(21) Appl. No.: 18/108,820

(22) Filed: Feb. 13, 2023

(65) Prior Publication Data

US 2023/0192351 A1 Jun. 22, 2023

Related U.S. Application Data

(63) Continuation of application No. PCT/KR2021/008615, filed on Jul. 7, 2021.

(30) Foreign Application Priority Data

Aug. 13, 2020 (KR) ..... 10-2020-0101827

(51) Int. Cl.
*B65D 3/08* (2006.01)
*A47G 19/22* (2006.01)
(Continued)

(52) U.S. Cl.
CPC ..... *B65D 3/08* (2013.01); *A47G 19/22* (2013.01); *B65D 3/12* (2013.01); *B65D 21/086* (2013.01); *A47G 2019/2277* (2013.01)

(58) Field of Classification Search
CPC ..... B65D 3/20; B65D 1/265; B65D 3/06; B65D 3/12; B65D 3/14; B65D 5/0209;
(Continued)

(56) References Cited

U.S. PATENT DOCUMENTS 11,203,448 B2 * 12/2021 Vetten ..... B31B 50/788
2021/0094720 A1 * 4/2021 Chan ..... B65D 3/20
2024/0002099 A1 * 1/2024 Drouet ..... B31B 50/732

FOREIGN PATENT DOCUMENTS

EP 3328748 B1 * 2/2022 ..... B31B 50/59
KR 101401814 B1 * 5/2014

* cited by examiner

*Primary Examiner* — Christopher R Demeree
(74) *Attorney, Agent, or Firm* — Park & Associates IP Law Office

(57) ABSTRACT

The present invention relates to a disposable folding paper cup that folds flat and, when unfolded by the pressing of a folded portion, has a cylindrical upper end, the paper cup comprising: a cup body, which is made of a coated paper of which the inner surface is coated with a cup body coating layer, forms a cylindrical shape when unfolded, and forms a flat surface when both sides thereof are folded at folding lines; bending lines forming oval press parts that unfold bisymmetrically around each folding line when the folding line height center portion of the cup body is pressed, and dividing the oval press parts, spaced from the upper and lower ends of the cup body, therefrom; a bottom sheet which is a coated paper having a bottom sheet coating layer formed on the surface thereof so as to be fused with the cup body coating layer at the inner side of the lower end of the cup body, of which both ends are primarily fused therewith while the bottom sheet is folded along a transverse center folding line that is upwardly convex, and which is fused with the bottom edge of the folded cup body to form a bottom fused band; and fusion columns at which the front and rear surfaces, having the folding line at the center thereof, and the bottom sheet, having the end portion fitted therebetween, form a column shape higher than the fusion height of the bottom fused band and lower than the lower end of the bending line, thereby fusing, at a portion at which the bottom
(Continued)

fused band and the folding line meet, the end portion of the bottom sheet through the three sides altogether.

6 Claims, 15 Drawing Sheets

(51) Int. Cl.
*B65D 3/12* (2006.01)
*B65D 21/08* (2006.01)

(58) Field of Classification Search
CPC ..... B65D 5/40; B65D 3/08; B65D 21/086; B65D 3/02; B65D 5/326; A47G 19/22; A47G 2019/2277; A47G 2400/10; A47G 19/2205
USPC ..... 229/405, 400, 4.5, 5.8
See application file for complete search history.

DISPOSABLE FOLDING PAPER CUP THAT FOLDS FLAT AND, WHEN UNFOLDED BY PRESSING OF FOLDED PORTION, HAS CYLINDRICAL UPPER END

REFERENCE TO RELATED APPLICATIONS

This is a continuation of International Patent Application PCT/KR2021/008615 filed on Jul. 7, 2021, which designates the U.S. and claims priority of Korean Patent Application No. 10-2020-0101827 filed on Aug. 13, 2020, the entire contents of which are incorporated herein by reference.

FIELD OF THE INVENTION

The present invention relates to a disposable folding paper cup which is folded flat and of which the upper end has a cylindrical shape when a folded portion is unfolded by being pressed.

BACKGROUND OF THE INVENTION

Paper cups are widely used in an automatic vending machine, in an office, at home, or outdoors, and has several advantages that can be mass-produced, is easy to handle, and enables resources to be recycled.

However, such disposable paper cups have a common cup shape that has a wide upper portion and a narrow lower portion. So, even though continuously stacked and inserted, the conventional disposable paper cups still have a burden of a volume caused by the original shape of the paper cup.

In order to solve such a problem, Korean Patent No. 10-1114236 discloses a folding paper cup which is usable in an erect state. In Korean Patent No. 10-1114236, FIG. 1 is a perspective view illustrating a folded state of a folding paper cup, FIG. 2 is a perspective view illustrating an expanded state of the folding paper cup of FIG. 1, FIG. 3 is an enlarged perspective view illustrating the bottom surface of the folding paper cup in the expanded state of FIG. 1, FIG. 4 is an exploded perspective view of the folding paper cup in the expanded state of FIG. 1, and FIG. 5 is a development view of the folding paper cup of FIG. 1.

As illustrated in the drawings, the folding paper cup includes a cup body 10 and a bottom sheet 20 made of paper coated with polyethylene on one surface thereof. The cup body 10 has an inner surface which is coated, and the bottom sheet 20 has an outer surface which is coated. Furthermore, since the cup body 10 needs to maintain an expanded state as it is when being expanded from a folded state, the cup body 10 is thicker than the bottom sheet 20, and the bottom sheet 20 is relatively thin and soft to facilitate folding and expansion.

The cup body 10 includes folding lines 11 and 11" folded to both sides with respect to the central line of the center in a state in which paper of a rectangular shape is cut. The folding lines 11 and 11" may be formed through a pressing action and may be formed in a dotted-line shape. In addition, as the curved lines 12 and 12" having curvatures are symmetrically formed in an oval shape at both sides of the folding lines 11 and 11', indentation portions 13 and 13" which are formed by the folding lines 11 and 11" and the curved lines 12 and 12" are formed at both sides. Bending points 14 and 14' formed at bent portions of upper and lower ends of the cub body 10 with respect to ends of the curved lines 12 and 12' serve to suppress and weaken a force that the upper and lower ends of the cup body 10 expanded into an oval shape return to the folded state, the bending points 14 and 14' keep the expanded cup body 10 as it is.

A bending line 15 is formed in a horizontal line with respect to the folding lines 11 and 11' perpendicular to the indentation portions 13 and 13'. When the paper cup is used, bending of the central portion of the indentation portions 13 and 13' of the curved surface by the bending line 15 serves to suppress a restoring force to return to the folded state. Moreover, the bottom sheet 20 fused onto the inner lower end of the cup body 10 is formed in such a way as to cut into a rectangular shape and to form a central folding line 21 horizontally traversing the central portion and both bent lines 22 and 22' vertically formed at both sides. In a state in which the bottom sheet 20 is halved and folded along the central folding line 21 such that the coated surface is located outside, both side ends are bonded to each other, and then, is folded as illustrated in FIG. 4. The folded ends are inserted into the inner lower end of the cup body 10, and then, are thermally fused with the cup body 10 to be attached and fixed.

In this instance, since the inner surface of the cup body 10 is coated by a coating layer, and the outer surface of the bottom sheet 20 is coated by a coating layer, in a state in which the inner surface of the cup body 10 and the outer surface of the bottom sheet 20 are overlapped with each other and a jig is inserted into the bottom sheet 20, they are pressed to come into close contact with each other using heat or high frequency or ultrasonic waves. Then, the coating layers (for instance, polyethylene) are fused and bonded to each other so that the cup body 10 and the bottom sheet 20 are attached to each other in a watertight state.

As described above, when the bottom sheet 20 is fused in the cup body 10, the paper cup becomes flat by the both folding lines 11 and 11' of the cup body 10 and the central folding line 21 of the bottom sheet 20. When a user simultaneously presses the both folding lines 11 and 11' with fingers, indentation portions 13 and 13' are formed by the curved lines 12 and 12', and the upper and lower ends of the cup body 10 is expanded. The central folding line 21 of the bottom sheet 20 of the inner lower end is unfolded by the expansion force of the cup body 10, and the both bent lines 22 and 22' is bent along the shape of the lower portion of the cup body 10 so as to form a round bottom portion.

Therefore, only the cup body 10 and the bottom sheet 20 located at the lower portion of the cup body 10 are formed in a single body, and the cup body 10 and the bottom sheet 20 are folded together to be folded and expanded together to be unfolded, and the expanded state is stably maintained even in the expanded state. Such a structure can contain more contents than a simple folding paper cup since the bottom sheet is widened horizontally when the paper cup is unfolded. However, the conventional folding paper cup has several disadvantages in that it may cause water leak while being unfolded, and in that it is difficult to use the cup body in a standing state since the bottom of the cup body is lifted up not to be horizontal when the lower end portion of the folding line acts as the indentation portion.

In order to solve the disadvantages, a double fusion method of fusing both folded ends of the bottom sheet and fusing the fused both ends with the cup body again is disclosed in Korean Patent No. 10-1401814. However, the double fusion method has a disadvantage in that a return phenomenon that the unfolded portion is folded by external shock during use often occurs after the folding paper cup is unfolded since the upper portion of the cup body is not formed in a circle when being unfolded.

SUMMARY OF THE INVENTION

Accordingly, the present invention has been made in view of the above-mentioned problems occurring in the related art, and it is an object of the present invention to provide a disposable folding paper cup in which both longitudinal ends of a bottom sheet are folded inward, bottom sheet coating layers are fused with each other, the fused bottom sheeting coating layers are overlapped at the inner lower portion of a cup body of a folded state, a coating layer of the cup body and the coating layer of the bottom sheet are fused with each other, and both ends of the bottom sheet coating layer and front and rear portion of both end portions are fused to have a fusion column to which the folding lines of the cup body are fused at three sides, thereby preventing water leak at a boundary portion between the cup body and the bottom sheet and preventing shape deformation by reinforcing a bearing force when unfolded.

It is another object of the present invention to provide a disposable folding paper cup in which a curved fusion line is located at an upper portion of the bottom sheet, both ends of the curved fusion line are located at the curved lines forming indentation portions, bottom fusion bands are fused in a state in which they are apart from each other up and down, thereby absorbing initial shock by a shock absorbing force due to the curved fusion line when unfolded, and maintaining the unfolded state for a long time by reducing a friction force and a storing force at both ends of the bottom portion since the curved fusion line is not fused inside the bending line when unfolded.

It is a further object of the present invention to provide a disposable folding paper cup in which a curved bottom is formed in such a way that the center of the bottom surface of the cup body is lifted up, so that the bottom of the cup body of an unfolded state keeps level by the curved bottom even though the folding line portion is lifted up when a user presses the indentation portions so that the folding paper cup stands on the floor. Moreover, a short axis of the indentation portion is larger than an interval between the bending lines forming the indentation portions to make an indentation depth deeper, so that the indentation portions have a rectangular shape when unfolded and the upper end of the cup body is formed in a circle since the bending lines are spaced apart from the upper end of the cup body, thereby allowing a user to drink the content without running the content from the mouth at any location.

It is a still further object of the present invention to provide a disposable folding paper cup which has a smooth uneven portion formed at the upper end of the cup body, thereby preventing a user's lips from being cut.

It is a further object of the present invention to provide a disposable folding paper cup in which both ends of the cup body and the bottom sheet form a fusion column, curved lines forming the indentation portions are formed in an oval shape, and the curved lines of the indentation portions and the cup body are spaced apart from each other, so that the bottom of the indentation portion forms an oval shape like a rugby ball to reinforce a bearing force in the form of a fusion column when the indentation portion around the folding line of the cup body of the folded state is pressed, the indentation portion forms a rectangular shape to increase gripping performance, and the upper end of the indentation portion forms a circular shape, thereby allowing the user to conveniently drink the content without leaking.

To accomplish the above-mentioned objects, according to the present invention, there is provided a disposable folding paper coup including: a cup body, which is made of a coated paper of which the inner surface is coated with a cup body coating layer, forms a cylindrical shape when unfolded, and forms a flat surface when both sides thereof are folded at folding lines; bending lines forming oval indentation portions which are unfolded bisymmetrically around each of the folding lines when height center portions of the folding lines of the cup body are pressed, and dividing the oval indentation portions, spaced from the upper and lower ends of the cup body; a bottom sheet which is a coated paper having a bottom sheet coating layer formed on the surface thereof so as to be fused with a cup body coating layer inside the lower end of the cup body, of which both ends are primarily fused with each other while the bottom sheet is folded along a transverse central folding line that is upwardly convex, and which is fused with the bottom edge of the folded cup body to form a bottom fusion band; and a fusion column which is formed at a portion where the bottom fusion band and the folding lines meet, is formed in a column form that the bottom sheet is higher than a fused height of the bottom fusion band but is lower than the lower ends of bending lines in a state in which end portions of the bottom sheet are inserted between front and rear surface based on the folding lines, such that the end portion of the bottom sheet is fused at three sides.

According to an embodiment of the present invention, a short axis of the unfolded indentation portions is larger than an interval between the bending line meeting the central bending line of the short axis and the bending line of the indentation portion opposed to the bending line.

According to an embodiment of the present invention, auxiliary bending lines are added to the upper and lower portions of the bending line.

According to an embodiment of the present invention, the bottom of the bottom sheet and the cup body respectively forms a bottom fusion band and a curved fusion line curved downward from both ends of the upper portion thereof to the center to be spaced apart from the bottom fusion band. Both ends of the curved fusion line correspond to the bending lines, and auxiliary bending lines are added to the indentation portions between the curved lines and a vertical line of a point where the curved fusion line and the curved lines meet together.

According to an embodiment of the present invention, a smoothly uneven portion is formed at the upper end of the cup body to prevent a user's lips from being cut.

According to an embodiment of the present invention, the bottom sheet fused at the inner bottom of the cup body has a plurality of crests and valleys continuously formed at the longitudinal central portion to reduce a friction force to the inner bottom of the cup body, thereby facilitating insertion into the cup body and closely contacting the bottom sheet with the inner wall of the cup body by the crests and the valleys which are pressed and stretched when being fused.

As described above, both longitudinal ends of a bottom sheet are folded inward, bottom sheet coating layers are fused with each other, the fused bottom sheeting coating layers are overlapped at the inner lower portion of a cup body of a folded state, a coating layer of the cup body and the coating layer of the bottom sheet are fused with each other, and both ends of the bottom sheet coating layer and front and rear portion of both end portions are fused to have a fusion column to which the folding lines of the cup body are fused at three sides, thereby preventing water leak at a boundary portion between the cup body and the bottom sheet and preventing shape deformation by reinforcing a bearing force when unfolded.

According to the present invention, the curved fusion line is located at an upper portion of the bottom sheet, both ends of the curved fusion line are located at the curved lines forming indentation portions, bottom fusion bands are fused in a state in which they are apart from each other up and down, thereby absorbing initial shock by a shock absorbing force due to the curved fusion line when unfolded, and maintaining the unfolded state for a long time by reducing a friction force and a storing force at both ends of the bottom portion since the curved fusion line is not fused inside the bending line when unfolded.

According to the present invention, the curved bottom is formed in such a way that the center of the bottom surface of the cup body is lifted up, so that the bottom of the cup body of an unfolded state keeps level by the curved bottom even though the folding line portion is lifted up when a user presses the indentation portions so that the folding paper cup stands on the floor. Moreover, a short axis of the indentation portion is larger than an interval between the bending lines forming the indentation portions to make an indentation depth deeper, so that the indentation portions have a rectangular shape when unfolded and the upper end of the cup body is formed in a circle since the bending lines are spaced apart from the upper end of the cup body, thereby allowing a user to drink the content without running the content from the mouth at any location.

According to the present invention, the disposable folding paper cup has the smooth uneven portion formed at the upper end of the cup body, thereby preventing a user's lips from being cut.

According to the present invention, both ends of the cup body and the bottom sheet form a fusion column, curved lines forming the indentation portions are formed in an oval shape, and the curved lines of the indentation portions and the cup body are spaced apart from each other, so that the bottom of the indentation portion forms an oval shape like a rugby ball to reinforce a bearing force in the form of a fusion column when the indentation portion around the folding line of the cup body of the folded state is pressed, the indentation portion forms a rectangular shape to increase gripping performance, and the upper end of the indentation portion forms a circular shape, thereby allowing the user to conveniently drink the content without leaking.

DETAILED DESCRIPTION OF THE INVENTION

Figure 1:
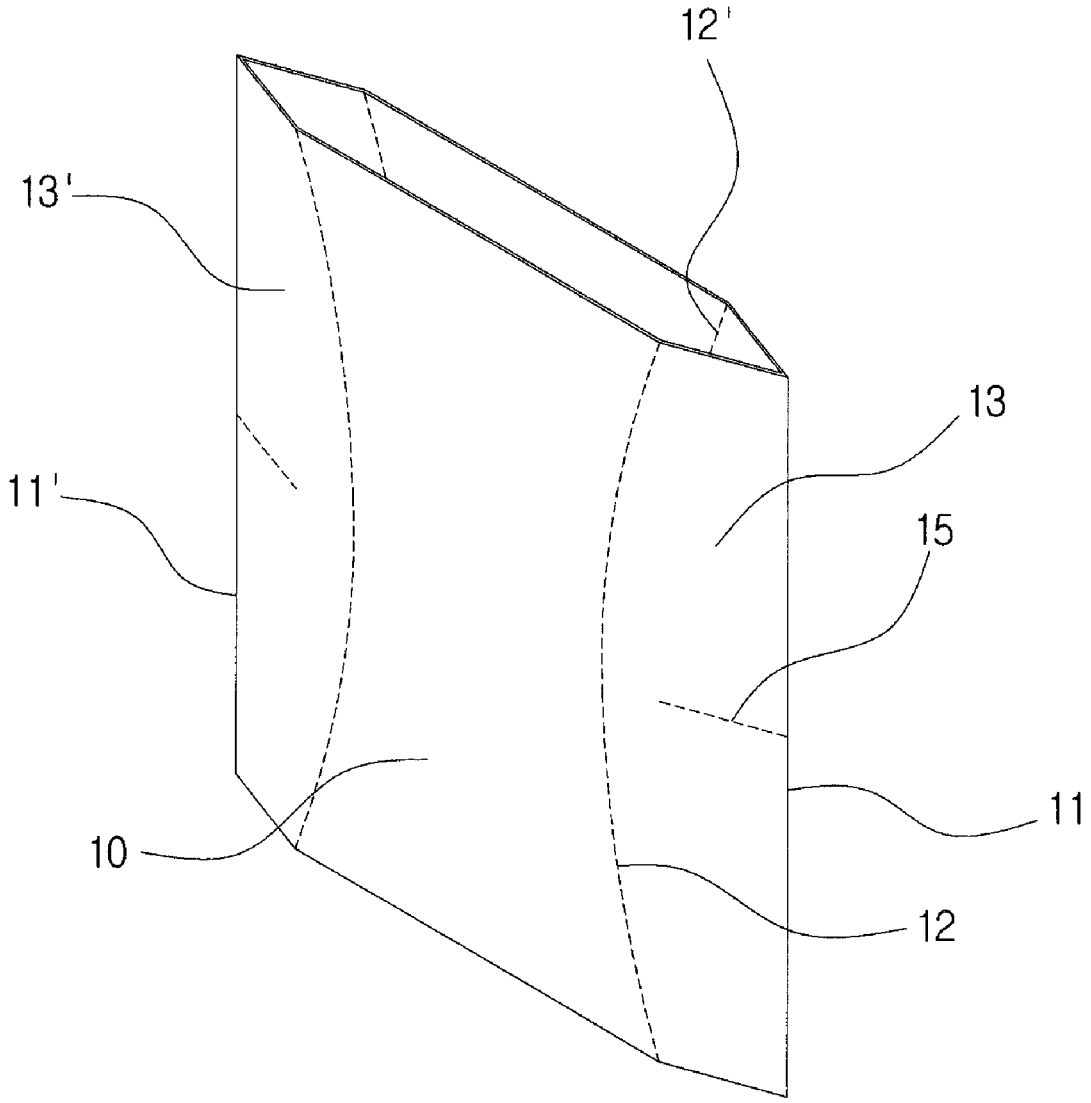
FIG. 1 is a perspective view of a folded state of a conventional folding paper cup.
Figure 2:
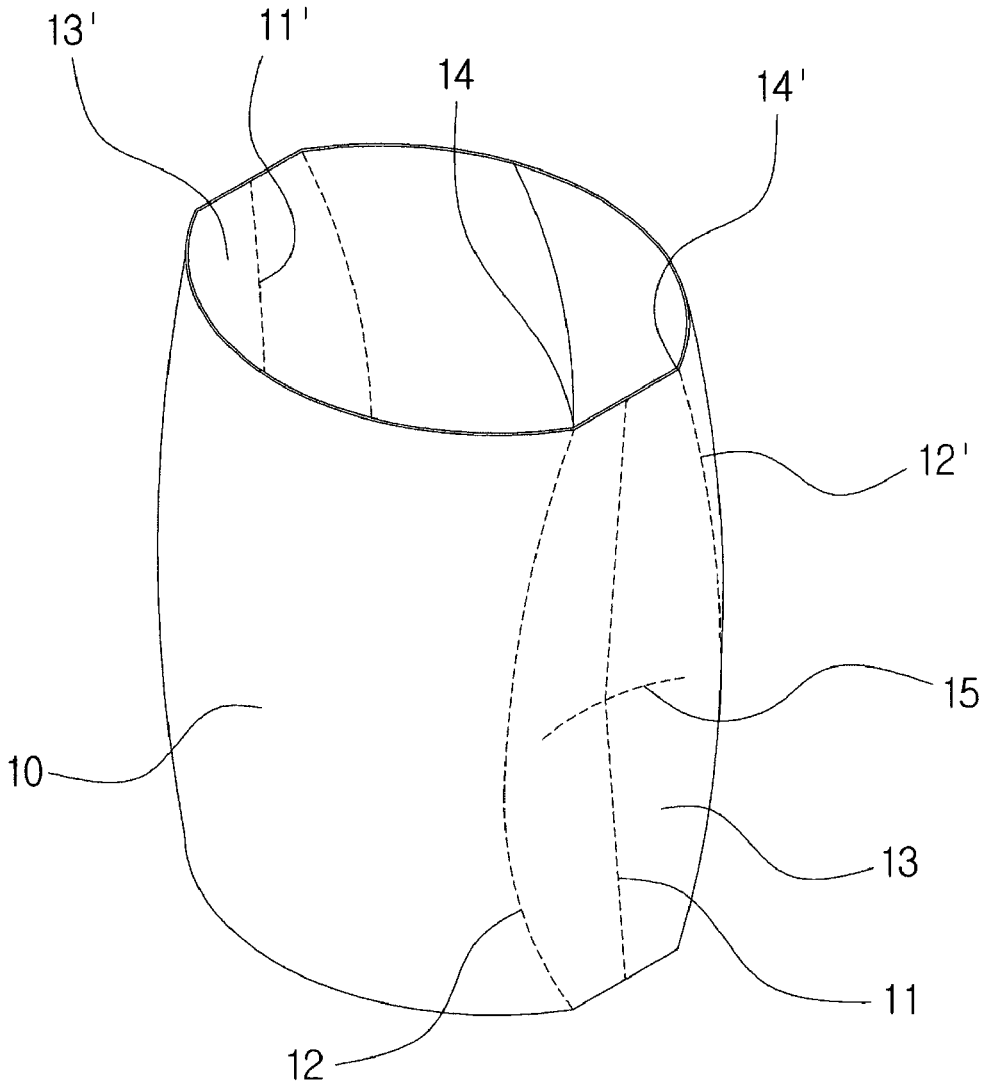
FIG. 2 is a perspective view illustrating an expanded state of the folding paper cup of FIG. 1.
Figure 3:
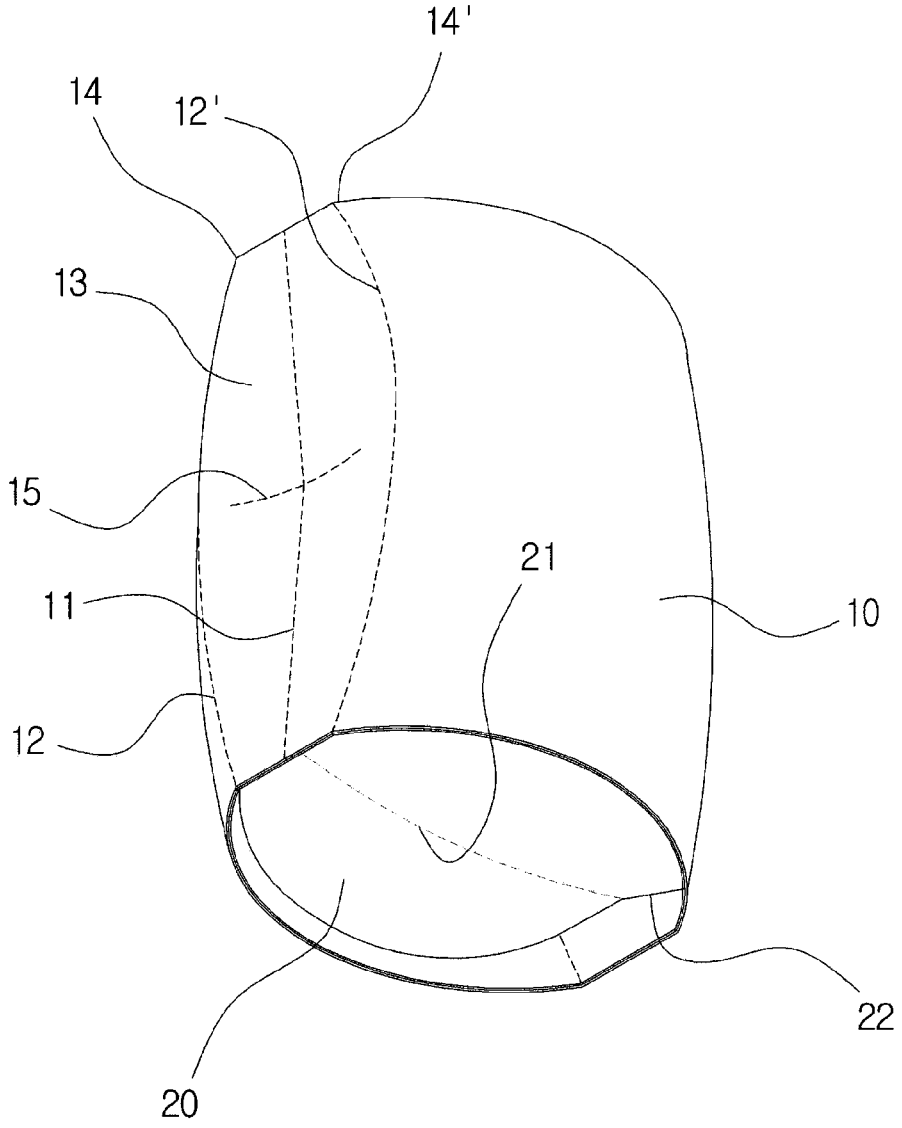
FIG. 3 is a bottom perspective view of the expanded state of the folding paper cup of FIG. 1.
Figure 4:
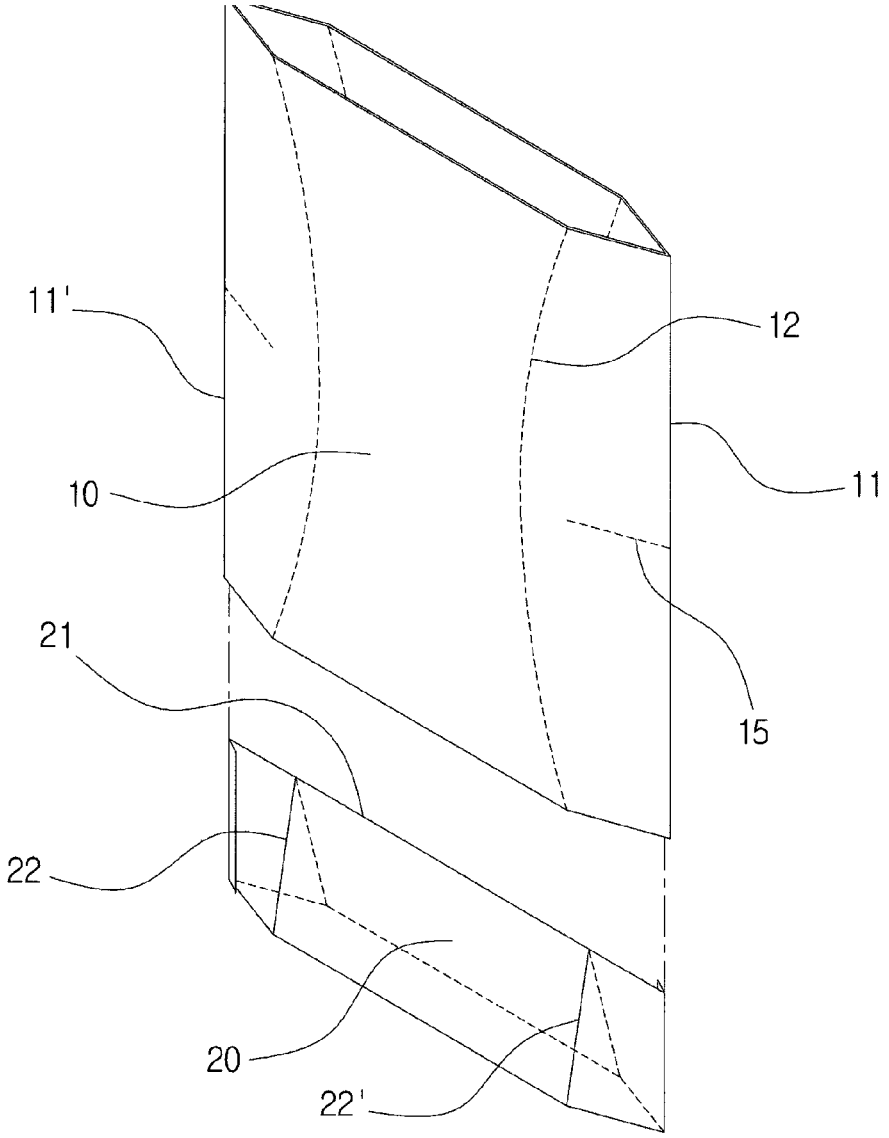
FIG. 4 is an exploded perspective view of the folding paper cup of FIG. 1.
Figure 5:
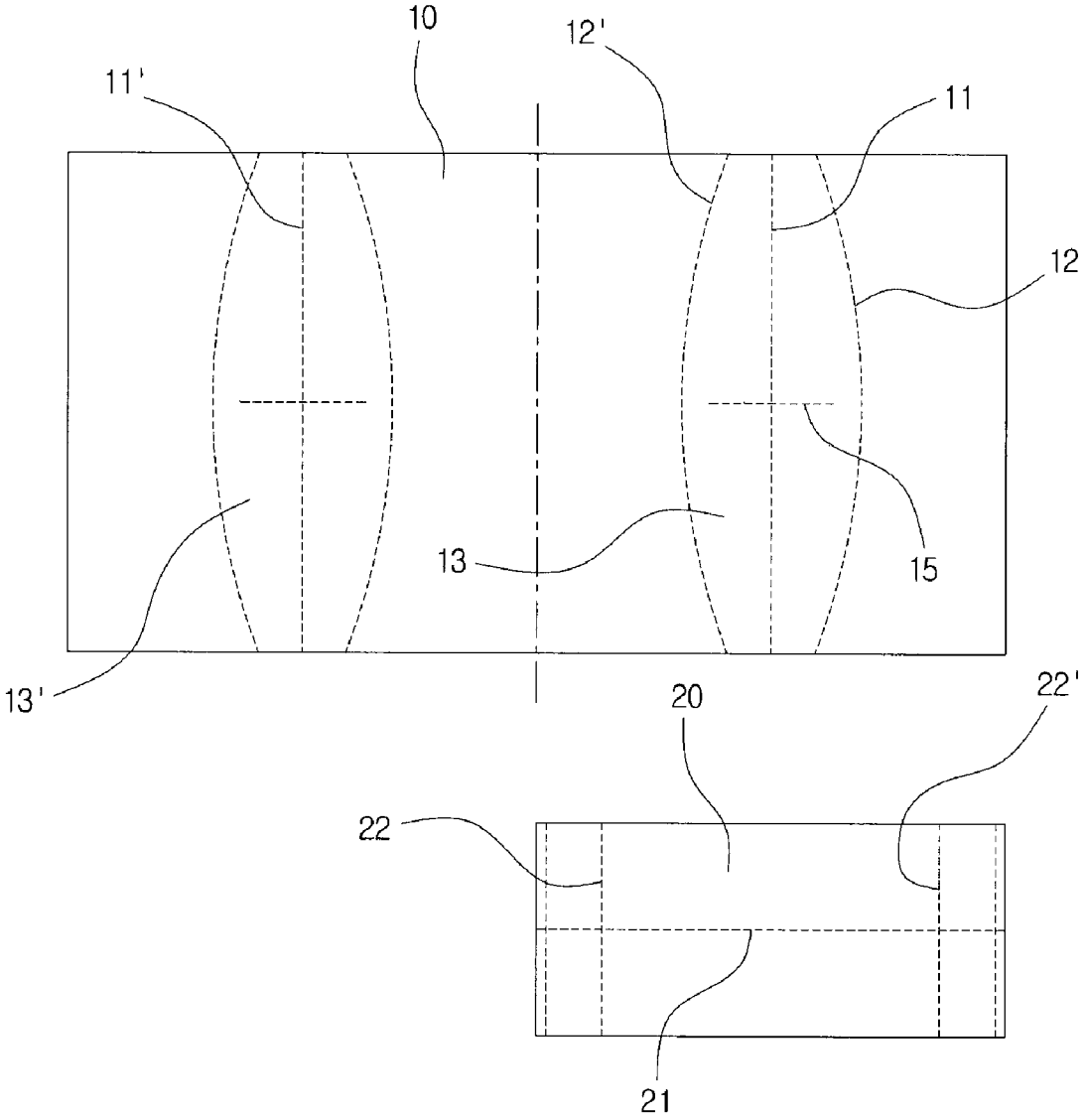
FIG. 5 is a development view of the folding paper cup of FIG. 1.

The present invention provides a disposable folding paper cup including: a cup body, which is made of a coated paper of which the inner surface is coated with a cup body coating layer, forms a cylindrical shape when unfolded, and forms a flat surface when both sides thereof are folded at folding lines; bending lines forming oval indentation portions which are unfolded bisymmetrically around each of the folding lines when height center portions of the folding lines of the cup body are pressed, and dividing the oval indentation portions, spaced from the upper and lower ends of the cup body; a bottom sheet which is a coated paper having a bottom sheet coating layer formed on the surface thereof so as to be fused with a cup body coating layer inside the lower end of the cup body, of which both ends are primarily fused with each other while the bottom sheet is folded along a transverse central folding line that is upwardly convex, and which is fused with the bottom edge of the folded cup body to form a bottom fusion band; and a fusion column which is formed at a portion where the bottom fusion band and the folding lines meet, is formed in a column form that the bottom sheet is higher than a fused height of the bottom fusion band but is lower than the lower ends of bending lines in a state in which end portions of the bottom sheet are inserted between front and rear surface based on the folding lines, such that the end portion of the bottom sheet is fused at three sides.

Hereinafter, preferred embodiments of the present invention will be described in detail with reference to the drawings of FIGS. 7 to 15.

A cup body 10 is made with coating paper having a coated inner surface and is in a folded state. When a user presses both folding lines 11 and 11' spaced apart from each other to unfold the cup body 10 which is in a folded state, folding lines 12 and 12' forming elliptical indentation portions 13 and 13' are formed. The indentation portions 13 and 13' are formed through bending lines 12*a* and 12'*a*, and are folded to be upwardly convex by a central folding line 21 formed in a horizontal direction at an inner lower portion of the cup body 10. A bottom sheet 20 made with coated paper coated with a bottom sheet coating layer 20*b* is fused with the cup body 10 by the outer surface of a bottom sheet base layer 20*a*.

Figure 12:
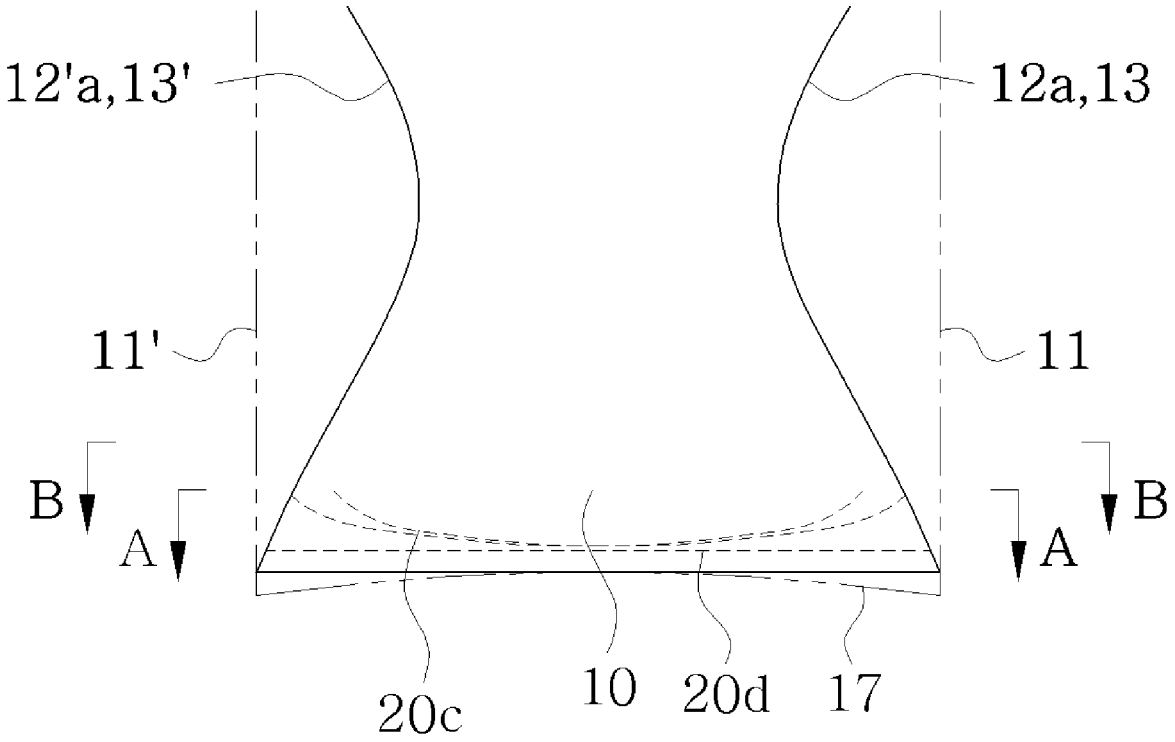
FIG. 12 is a view illustrating a principle in which a curved bottom of a cup body of the present invention is horizontal.
Figure 15:
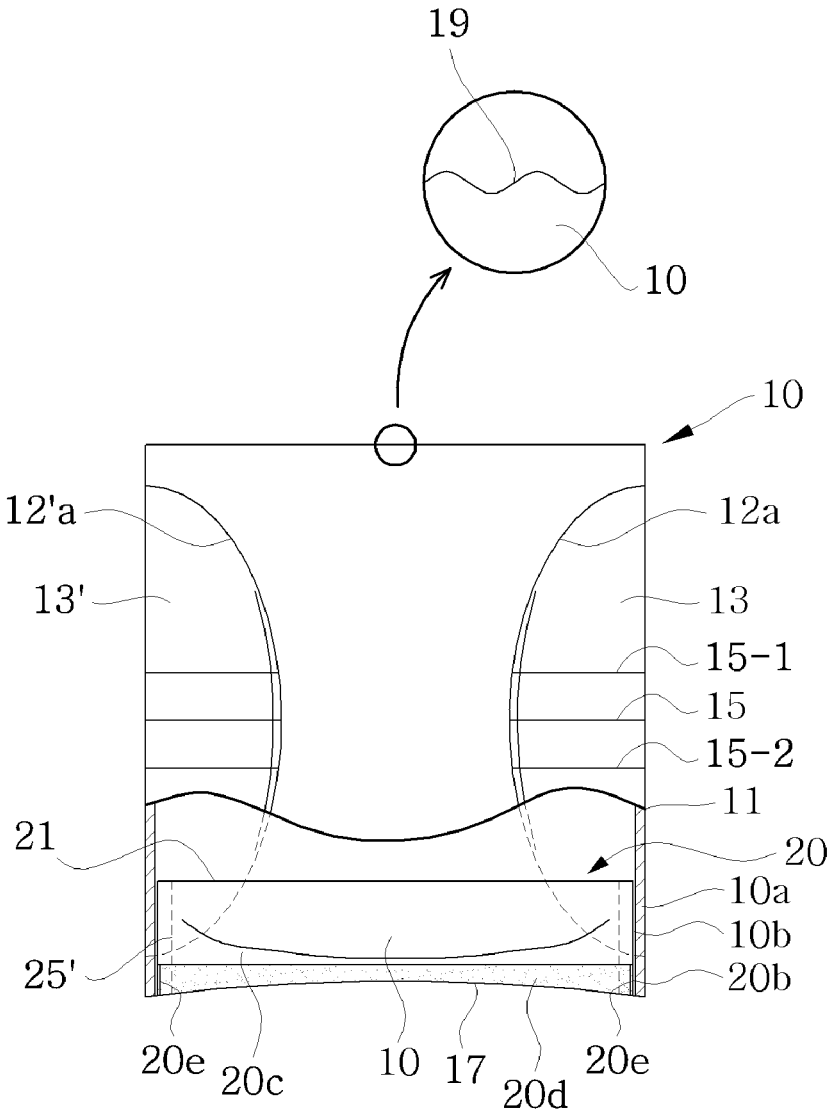
FIG. 15 is a front view illustrating a portion of the present invention is cut.

A curved fusion line 20*c* curved downward toward the center from the bottom sheet 20 meeting the bending lines 12*a* and 12'*a* is additionally fused as illustrated in FIGS. 12 and 15.

In addition, a lower end portion of the bottom sheet 20 and the inner surface of the cup body 10 are additionally fused below the curved fusion line 20*c* to be spaced apart from the curved fusion line 20*c*, thereby forming a bottom fusion band 20*d*. At a portion where the bottom fusion band 20*d* and the folding lines 11 and 11' meet, end portions of the bottom sheet 20 are inserted between front and rear surface based on the folding lines 11 and 11'. The end portions of the bottom sheet 20 are fused in such a way that a fusion column 20*e* having three sides is formed. The fusion column 20*e* of the bottom sheet 20 has a column shape which is higher than a fused height of the bottom fusion band 20*d* but is lower than the lower end of the bending lines 12 and 12'.

Figure 10:
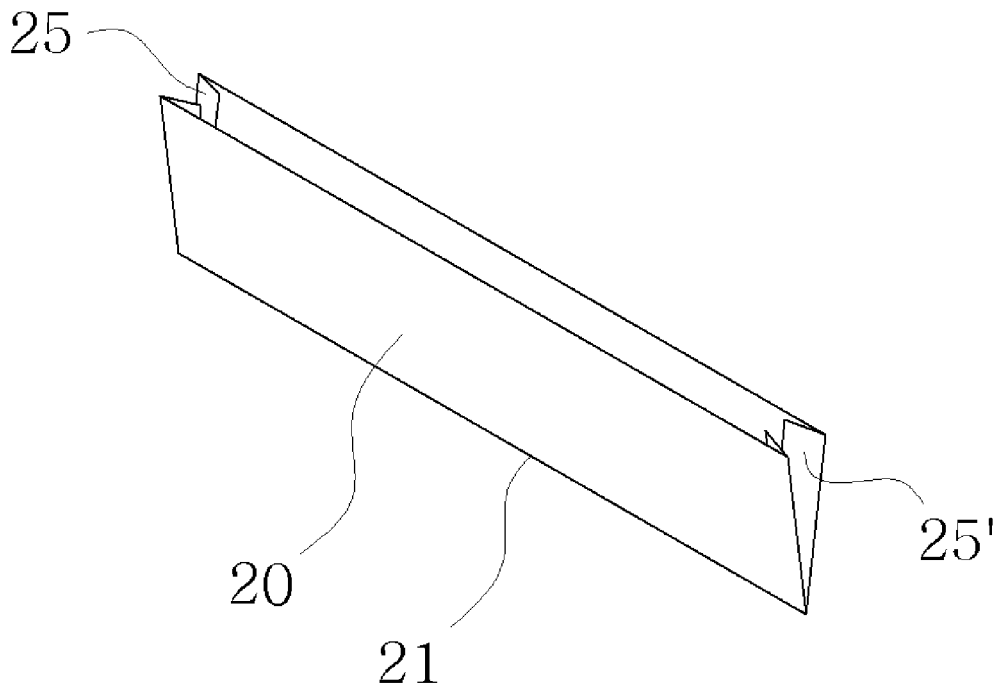
FIG. 10 is a perspective view illustrating a state in which paper is primarily folded to manufacture a bottom sheet of the present invention.
Figure 11:
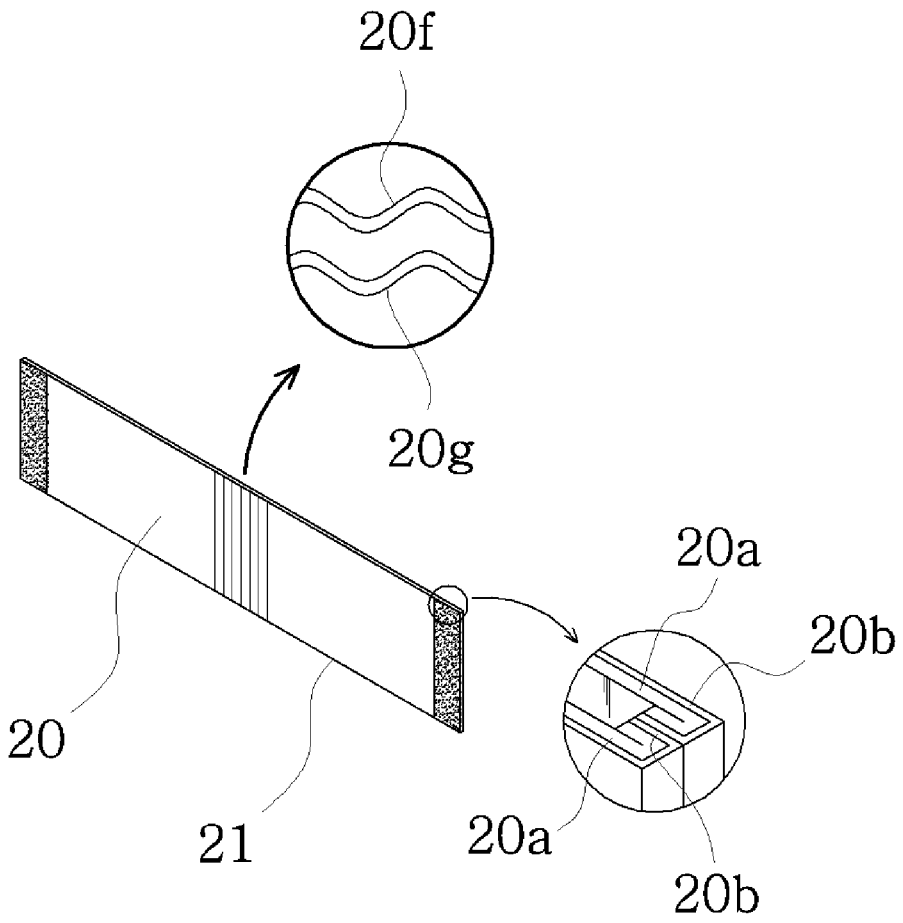
FIG. 11 is a perspective view illustrating a state in which the paper is secondarily folded and is fused to manufacture a bottom sheet according to the present invention.

Longitudinal both end surfaces 25 and 25' formed by the central folding line 21 are folded inward to have a predetermined width as illustrated in FIG. 10. Thereafter, the bottom sheet coating layers 20*b* coated on the bottom sheet base layers 20*a* of the both end surfaces 25 and 25' as illustrated in FIG. 11 are fused to each other so that the bottom sheet 20 is formed.

The bottom sheet 20 fused onto the inner bottom of the cup body 10 has a plurality of crests 20*a* and valleys 20*b* continuously formed at the central portion thereof to reduce a friction force with the inner bottom of the cup body 10. So, the bottom sheet 20 is easily inserted into the cup body 10, and the inner wall of the cup body 10 and the bottom sheet 20 are fused in a contact state since the crests 20*a* and the valleys 20*b* of the bottom sheet 20 are pressed and straightened when being fused.

Figure 13:
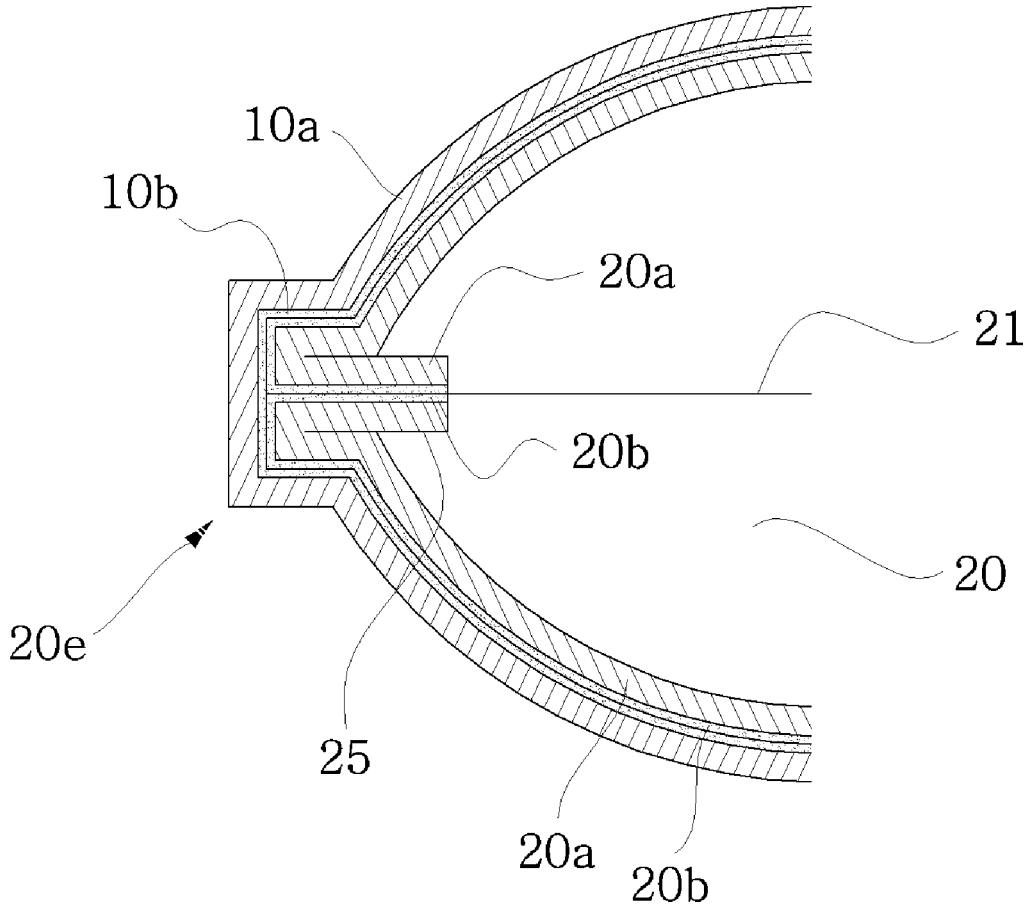
FIG. 13 is an enlarged view of essential parts illustrating a state in which indentation portions are not pressed to the A-A line state of FIG. 12.

Furthermore, since the bottom sheet coating layers 20*b* are exposed to the surface of the bottom sheet 20, the bottom sheet coating layers 20*b* and a cup body coating layer 10*b* of the inner surface of the cup body 10 are fused in such a way that the upper portion forms the curved fusion line 20*c*, the lower portion forms the bottom fusion band 20*d*, and both ends form the fusion column 20*e* as illustrated in FIG. 15 according to the principle of FIG. 13. Accordingly, the disposable folding paper cup according to the present invention secures sealability by the bottom fusion band 20*d* and the fusion column 20*e* of the lower portion, and shows a form maintenance function and a shock absorption function by the curved fusion line 20*c* when being unfolded, thereby stably maintaining the unfolded state due to bearing power of the fusion column even after being unfolded.

A portion near the folding line 11 is not fused with the cup body 10 to be as high as the bottom sheet 20 of the folded state but is divided into the curved fusion line 20*c*, which is fused in a line form, and the bottom fusion band 20*d*, which is spaced downward and fused in a band form, to be fused at an upper portion and a lower portion. Accordingly, the paper cup is easily unfolded when the indentation portions 13 are pressed since bearing power is weakened, and the unfolded state can be maintained since the fusion column 20*e* supports with a strong bearing power.

Figure 9:
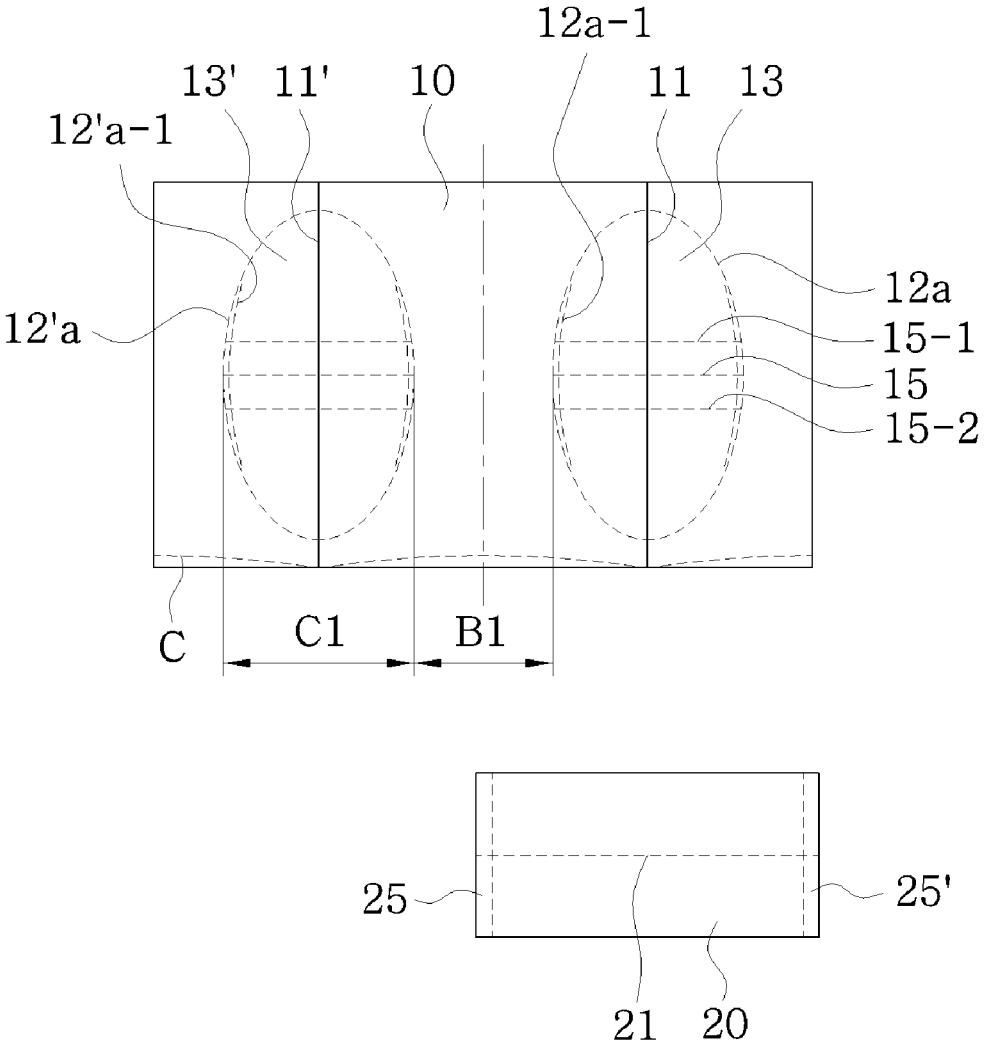
FIG. 9 is a development view of the folding paper cup according to the present invention.

The bottom of the cup body 10 between the folding lines 11 and 11' is cut to form a curved bottom 17 which is curved upward from the lower end corresponding to the folding lines 11 and 11' toward the center between the folding lines 11 and 11'. When a cutting line (c) illustrated in FIG. 9 is cut after being fused with the bottom sheet 20, the curved bottom 17 is formed. The reason is that the folding lines 11 and 11' are lifted up when the indentation portions 13 and 13' near the folding lines 11 and 11' are pressed so that the curved bottom 17 becomes a horizontal surface.

That is, in the folded state, the height of the curved bottom 17 between the folding lines 11 and 11' coincides with the height of the lifted lower ends of the folding lines 11 and 11' of the unfolded state (indicated by the solid line of FIG. 12).

The bottom sheet 20 illustrated in FIG. 9 is folded on the basis of the central folding line 21 so that the bottom sheet coating layer 20*b* becomes the surface, the both end surfaces 25 and 25' are folded to both end portions of the central folding line 21, and the bottom sheet coating layers 20*b* of the outside illustrated in FIGS. 11 and 13 are fused to each other in the state in which the both end surfaces 25 and 25'*a* are folded, thereby completing the bottom sheet. Additionally, the plurality of crests 20*f* and valleys 20*g* are continuously formed at the center of the bottom sheet 20 in the width direction so that the length of the bottom sheet 20 is forcedly reduced. Accordingly, the bottom sheet 20 can be easily inserted into the cup body 10.

As illustrated in FIG. 9, a coated paper is cut in a longitudinal direction, press work is performed to form an indentation portion 13 in a press groove type by folding lines 11 and 11' and bending lines 12*a* and 12'*a*, the center is folded so that edge portions are overlapped, and then, both ends are fused, thereby forming a cup body 10 of a folded form.

The bottom sheet is folded and edges are fused as illustrated in FIG. 11, the central folding line 21 of the bottom sheet 20 having the plurality of crests 20*f* and valleys 20*g* at the center is located up. Thereafter, the bottom sheet is located between the cup body 10 in the state of FIG. 8, the bottom sheet 20 having the crests 20*f* and the valleys 20*g* is provided to the inner bottom of the cup body 10 to be easily overlapped without friction with both ends. When the bottom sheet and the cup body are fused by high frequency, the crests 20*f* and the valleys 20*g* are pressed to be straightened flat, and end portions of the bottom sheet 20 come into close contact with the folding lines 11 and 11' of the cup body 10 to be fused.

As illustrated in FIGS. 12 and 15, the inner surface of the cup body 10 and the surface of the bottom sheet 20 are further fused in the form of the curved fusion line 20*c* to be curved downward between the folding lines 11 and 11'. In addition, a bottom fusion band 20*d* is formed below the curved fusion line 20*c* to be spaced apart from the curved fusion line 20*c*. At a portion where the bottom fusion band 20*d* and the folding lines 11 and 11' meet, end portions of the bottom sheet 20 are inserted between front and rear surface based on the folding lines 11 and 11'. The end portions of the bottom sheet 20 are fused in such a way that a fusion column 20*e* having three sides is formed. The fusion column 20*e* of the bottom sheet 20 has a column shape which is higher than a fused height of the bottom fusion band 20*d* but is lower than the lower end of the bending lines 12 and 12'. For example, fusion may be high frequency fusion or ultrasonic fusion, but the present invention is not limited thereto.

Figure 6:
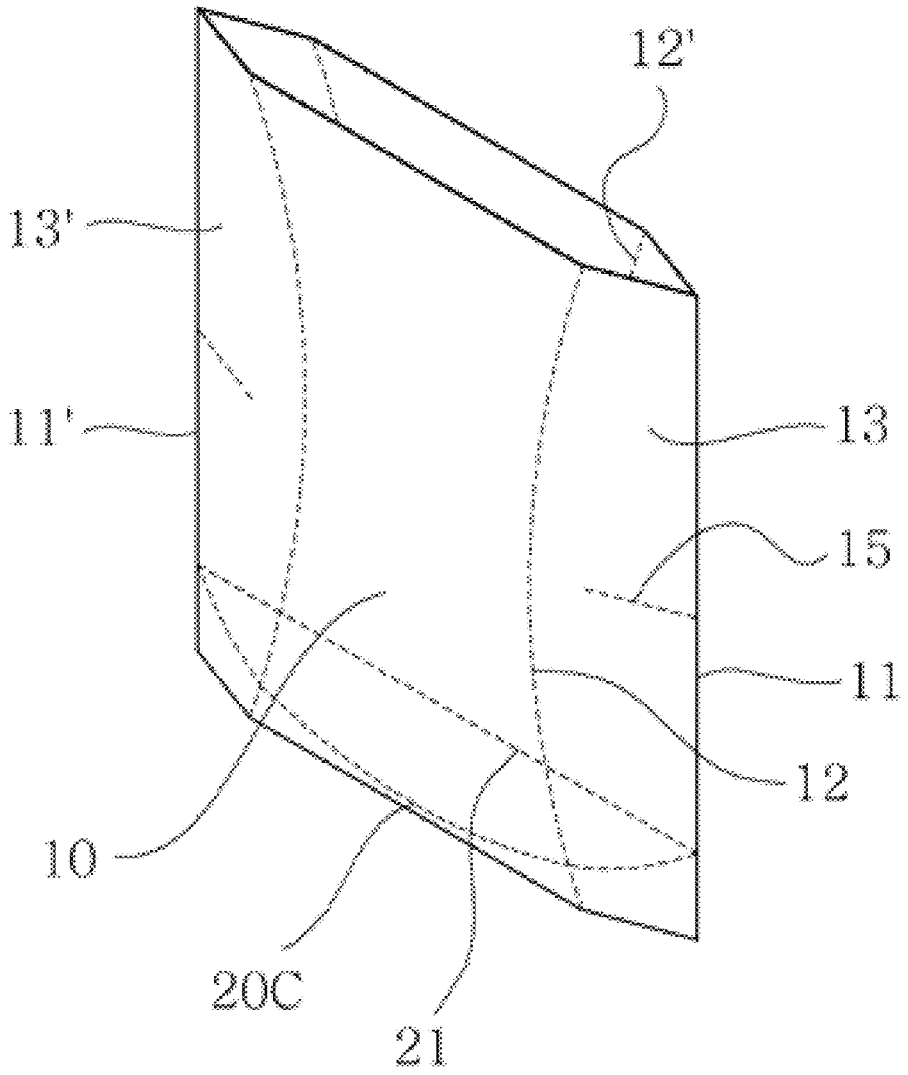
FIG. 6 is a perspective view illustrating a folded state of the conventional folding paper cup.

As illustrated in FIGS. 6, 12 and 15, the bottom sheet 20 fused with the cup body 10 is fused to form the curved fusion line 20*c*, the bottom fusion band 20*d*, and the fusion column 20*e*, and the bottom surface of the bottom fusion band 20*d* is cut to form a curved bottom 17.

Figure 7:
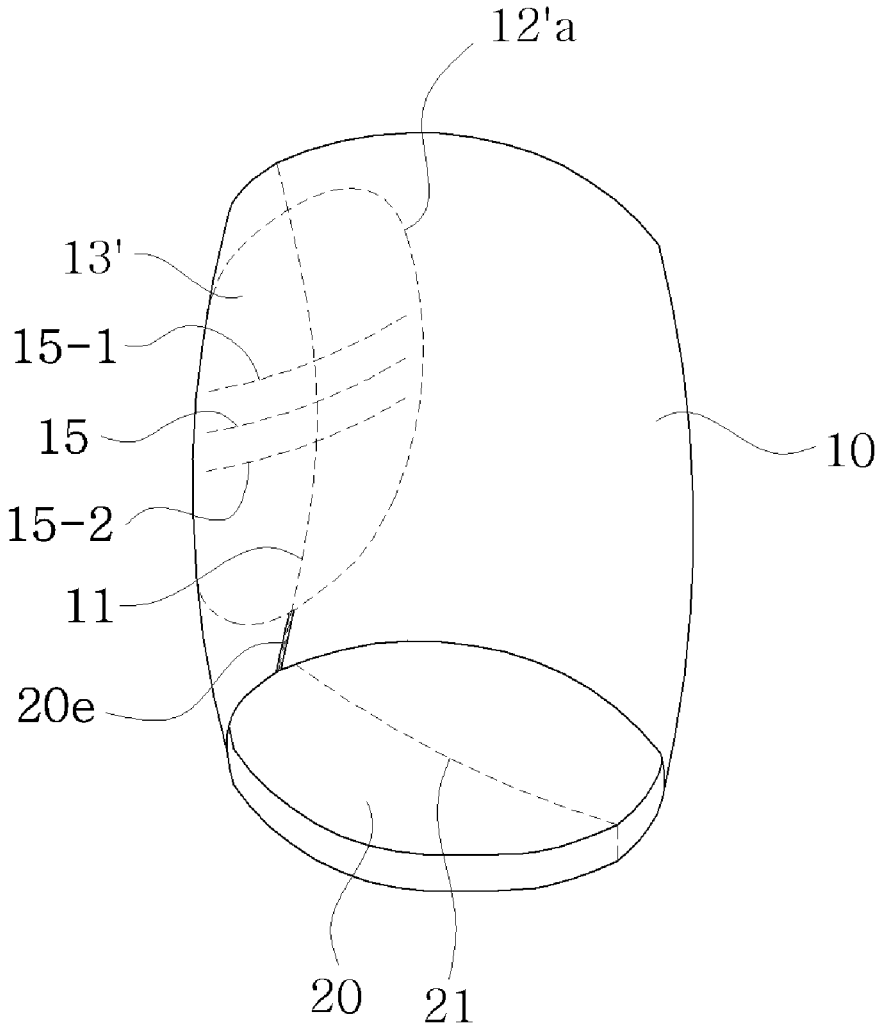
FIG. 7 is a bottom perspective view illustrating an expanded state of a folding paper cup according to the present invention.
Figure 8:
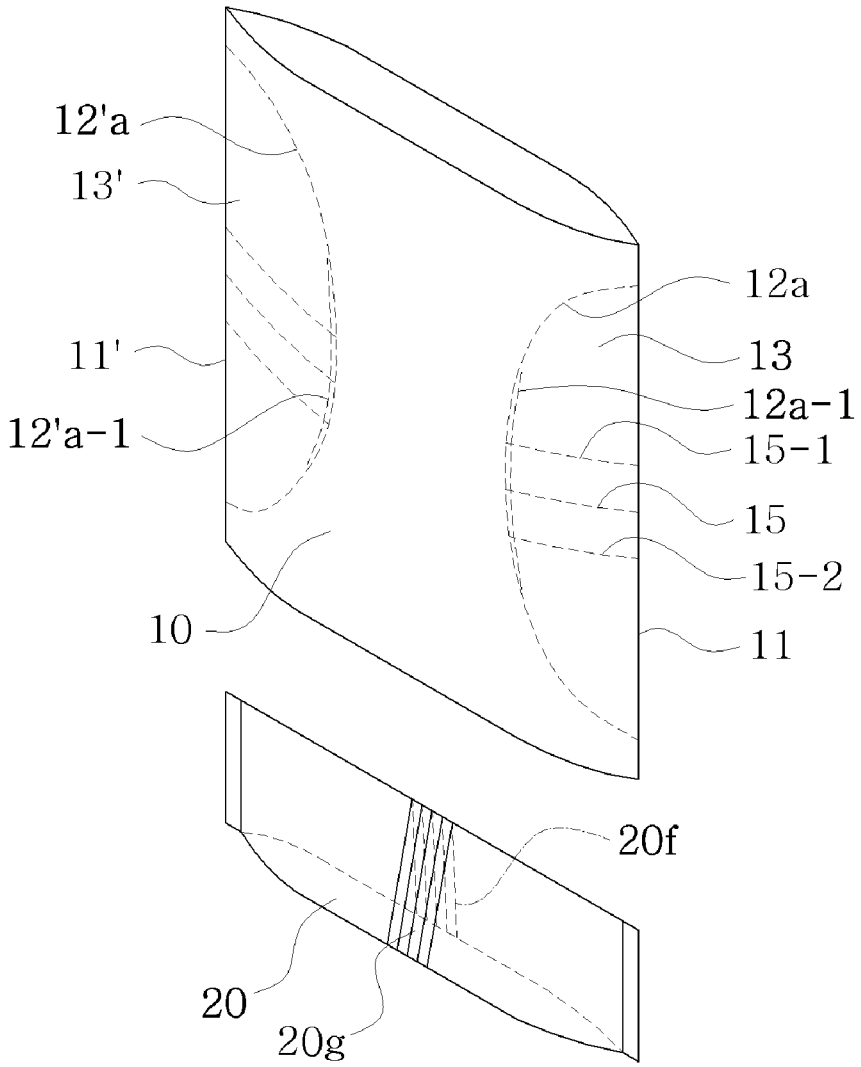
FIG. 8 is an exploded perspective view before fusion of the folding paper cup according to the present invention.

In a case in which the disposable folding paper cup manufactured as the above is used, when a user presses the bending line 15 in the folded state as illustrated in FIG. 15, the indentation portion 13 is dented inward from the cup body 10, and the formed cup shape illustrated in FIG. 7 is maintained so that the user can use the folding paper cup like a general cup.

That is, in the folded state, the bottom of the cup body 10 forms the curved bottom 17 like the dotted state of FIG. 12. However, when the user presses the indentation portions 13 and 13', a bending line 15 and auxiliary bending lines 15-1 and 15-2 are bent to be recessed. So, the upper portion of the cup body 10 is widened to form a circle like a general cup. In this instance, since the lower end portions of the folding lines 11 and 11' are lifted up from the dotted line state to the solid line state, the widened bottom becomes flat, so that the user can use the folding paper cup in a state in which the cup stands on the floor like a general cup.

In this case, the fusion column 20*e* firmly supports the bottom of the cup body 10 like a column to prevent transformation since the lower end portions of the folding lines 11 and 11' of the cup body 10 are fused with the bottom sheet 20 at three sides (front side, rear side, and lateral side).

Figure 14:
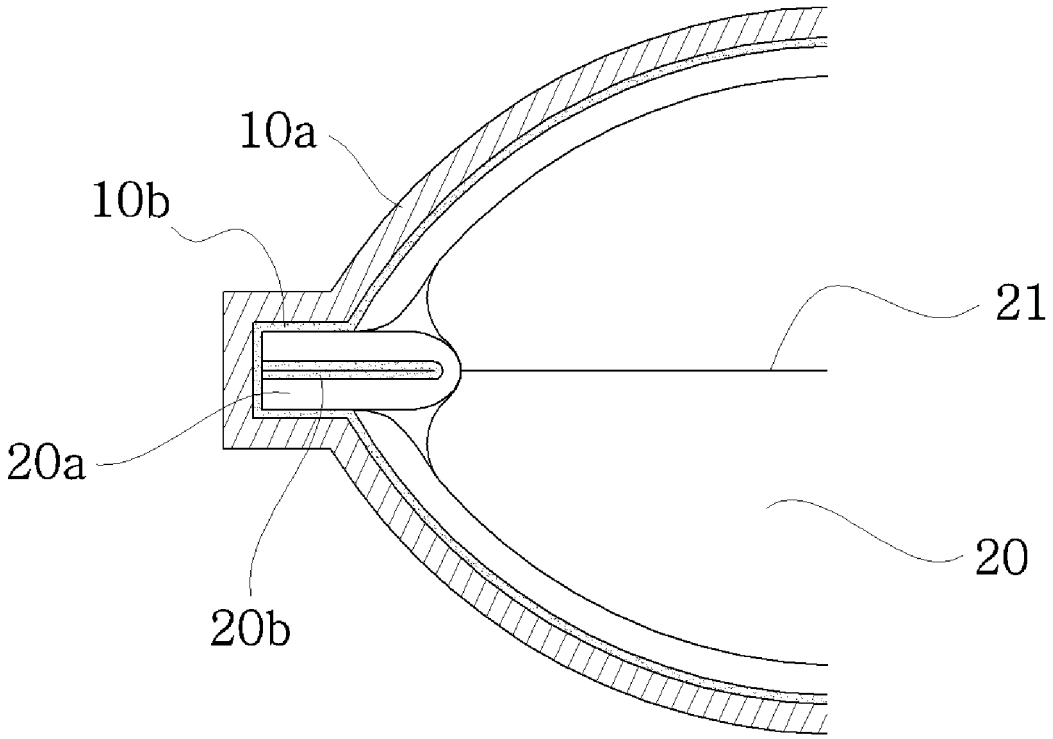
FIG. 14 is an enlarged view of essential parts illustrating a state in which the indentation portions are pressed to the B-B line state of FIG. 12.

In addition, as illustrated in FIGS. 10 and 11, in order to manufacture a paper cup, the both end surfaces 25 and 25' are folded inward and the bottom sheet coating layers 20*b* are fused to each other, and then, the cup body coating layer 10*b* and the bottom sheet coating layer 20*b* of the outer surface of the bottom sheet 20 are fused integrally at three sides inside the cup body 10 (fused such that an upper portion and a lower portion are spaced apart from each other so that the being lines 12*a* and 12'*a* are formed at the upper portion and the bottom fusion band 20*d* is formed at the lower portion). As illustrated in FIGS. 13 and 14, in a case in which the indentation portion 13 is pressed, the both end surfaces 25 are simultaneously fused to the folding lines 11 and 11' of the cup body 10 and the three sides of the front and rear surfaces to form the fusion column 20*e*. The bottom surfaces 25 and 25' fused at the edge portions of the bottom sheet 20 which are not fused to the fusion column 20*e* maintain the unfolded state since not being fused to the cup body 10 as illustrated in FIG. 14 and not receiving anti-unfolding power, and the edges of the bottom sheet 20 do not have water leak, so that the folding paper cup can be used like a general cup.

Moreover, since a short axis C1 of the bending lines 12*a* and 12'*a* partitioning the indentation portion 13 is larger than an interval B1 between the bending lines, the bending line portion of the cup body 10 forms a bending angle and a bending depth in the form of approximately square shape on the plane. Accordingly, auxiliary bending lines 12*a*-1 and 12'*a*-1 are provided to prevent the bending lines 12*a* and 12'*a* from being restored or being torn when being suddenly pressed. Since the auxiliary bending lines 12*a*-1 and 12'*a*-1 are provided to prevent the bending lines 12*a* and 12'*a* from being restored or being torn, pressing power applied only to the bending lines 12*a* and 12*a*' is dispersed, thereby reinforcing a form-maintaining force, and doubly dispersing and absorbing the restoring force applied when the folding paper cup is filled with contents. The auxiliary bending lines 12*a*-1 and 12'*a*-1 are located between both end vertical lines of the curved fusion line 20*c* to support internal pressure applied vertically.

As illustrated in FIG. 15, a sharp and flat blade shape but an uneven portion 19 is formed at an edge of the upper end of the cup body 10. Since the uneven portion does not have a blade portion, it can prevent a user's lips from being cut. In addition, even when the user drinks hot water, the uneven portion 19 prevents the user's lips from getting scalded since reducing a contact area between the content and the user's lips.

The disposable folding paper cup according to the present invention can be widely used in an automatic vending machine, in an office, at home, or outdoors, and allows a user to easily store and use.

What is claimed is:

1. A disposable folding paper cup comprising:

a cup body (10), which is made of a coated paper of which the inner surface is coated with a cup body coating layer (10*b*), forms a cylindrical shape when unfolded, and forms a flat surface when both sides thereof are folded at folding lines (11, 11');

bending lines (12*a*, 12'*a*) forming oval indentation portions (13, 13') which are unfolded bisymmetrically around each of the folding lines (11, 11') when height center portions of the folding lines (11, 11') of the cup body (10) are pressed, and dividing the oval indentation portions (13, 13'), spaced from the upper and lower ends of the cup body (10);

a bottom sheet (20) which is a coated paper having a bottom sheet coating layer (20*b*) formed on the surface thereof so as to be fused with a cup body coating layer (10*b*) inside the lower end of the cup body (10), of which both ends are primarily fused with each other while the bottom sheet is folded along a transverse central folding line (21) that is upwardly convex, and which is fused with the bottom edge of the folded cup body (10) to form a bottom fusion band (20*d*); and a fusion column (20*e*) which is formed at a portion where the bottom fusion band (20*d*) and the folding lines (11, 11') meet, is formed in a column form that the bottom sheet (20) is higher than a fused height of the bottom fusion band (20*d*) but is lower than the lower ends of bending lines (12, 12') in a state in which end portions of the bottom sheet (20) are inserted between front and rear surface based on the folding lines (11, 11'), such that the end portion of the bottom sheet 20 is fused at three sides.

2. The disposable folding paper cup according to claim 1, wherein a short axis (C1) of the unfolded indentation portions (13, 13') is larger than an interval (B1) between the bending line (12*a*) meeting the central bending line (15) of the short axis (C1) and the bending line (12'*a*) of the indentation portion (13') opposed to the bending line (12*a*).

3. The disposable folding paper cup according to claim 2, wherein auxiliary bending lines (15-1, 15-2) are added to the upper and lower portions of the bending line (15).

4. The disposable folding paper cup according to claim 1, wherein the bottom of the bottom sheet (20) and the cup body (10) respectively forms a bottom fusion band (20*d*), and a curved fusion line (20*c*) curved downward from both ends of the upper portion thereof to the center to be spaced apart from the bottom fusion band (20*d*), and wherein both ends of the curved fusion line (20*c*) correspond to the bending lines (12*a*, 12'*a*), and auxiliary bending lines (12*a*-1, 12*a*-2) are added to the indentation portions (13, 13') between the curved lines (12*a*, 12'*a*) and a vertical line of a point where the curved fusion line (20*c*) and the curved lines (12, 12'*a*) meet together.

5. The disposable folding paper cup according to claim 1, wherein a smoothly uneven portion (19) is formed at the upper end of the cup body (10) to prevent a user's lips from being cut.

6. The disposable folding paper cup according to claim 1, wherein the bottom sheet (20) fused at the inner bottom of the cup body (10) has a plurality of crests (20*a*) and valleys (20*b*) continuously formed at the longitudinal central portion to reduce a friction force to the inner bottom of the cup body (10), thereby facilitating insertion into the cup body (10) and closely contacting the bottom sheet (20) with the inner wall of the cup body (10) by the crests and the valleys which are pressed and stretched when being fused.

* * * * *